US007571902B2

(12) United States Patent
Carter et al.

(10) Patent No.: US 7,571,902 B2
(45) Date of Patent: Aug. 11, 2009

(54) SHEET MATERIAL CONVEYING APPARATUS WITH DUAL-BOTTOM POCKETS

(75) Inventors: Richard Alan Carter, Barrington, NH (US); Dennis Lee Wake, Northwood, NH (US)

(73) Assignee: Goss International Americas, Inc., Durham, NH (US)

( * ) Notice: Subject to any disclaimer, the term of this patent is extended or adjusted under 35 U.S.C. 154(b) by 850 days.

(21) Appl. No.: 10/991,166

(22) Filed: Nov. 17, 2004

(65) Prior Publication Data

US 2006/0157923 A1 Jul. 20, 2006

(51) Int. Cl.
*B42B 9/00* (2006.01)

(52) U.S. Cl. ..... 270/52.2; 270/58.29

(58) Field of Classification Search ..... 271/299, 271/223; 270/52.14, 52.16, 52.17, 52.18, 270/52.2, 58.23, 58.29, 58.18, 58.1, 58.11, 270/58.16, 58.07, 58.08

See application file for complete search history.

(56) References Cited

U.S. PATENT DOCUMENTS

| | | | | |
|---|---|---|---|---|
| 4,124,203 | A * | 11/1978 | Muller | 270/52.2 |
| 5,251,888 | A | 10/1993 | Eugster | 270/55 |
| 5,527,025 | A * | 6/1996 | Schlough | 270/58.06 |
| 5,911,416 | A | 6/1999 | Klopfenstein | 271/223 |
| 5,921,538 | A * | 7/1999 | Schlough | 270/52.18 |
| 6,199,354 | B1 * | 3/2001 | King et al. | 56/11.3 |
| 6,390,469 | B1 | 5/2002 | Jones et al. | |
| 6,695,306 | B2 | 2/2004 | Kaya et al. | 271/187 |
| 6,830,241 | B1 | 12/2004 | Klopfenstein | |

* cited by examiner

*Primary Examiner*—Patrick H Mackey
*Assistant Examiner*—Jeremy Severson
(74) *Attorney, Agent, or Firm*—Davidson, Davidson & Kappel, LLC

(57) ABSTRACT

A sheet material conveying apparatus includes a plurality of pockets running along a track, each pocket having a bottom and a second bottom movable between a first location where the second bottom is over the bottom, and a second location where the second bottom is not located over the bottom. An actuator is located to a side of the pockets for moving the second bottom between the first and second locations. A related pocket and a method are also provided.

16 Claims, 6 Drawing Sheets

SHEET MATERIAL CONVEYING APPARATUS WITH DUAL-BOTTOM POCKETS

BACKGROUND OF THE INVENTION

The present invention relates generally to a sheet conveying apparatus, for example, for conveying newspapers or other printed material, and more particularly to a sheet conveying apparatus having pockets moving on a track. The present invention also relates to such pockets and to a method for providing that the pockets can receive at least two different formats of products.

U.S. Pat. No. 5,911,416 describes a sheet material conveying apparatus with a plurality of pockets moveable around a track to accept sheet material from sheet material feeders. These pockets permit for example a first outer section of a newspaper to first be fed into the pockets by a first sheet material feeder, and then an inner newspaper section to be inserted between the folds of the first outer newspaper section.

U.S. Pat. No. 5,251,888 purports to describe pockets moveable along an endless path. Each pocket is provided with two vertically adjustable stops mounted displaceably in a pocket carrier. A guide member purportedly can be set to vertically adjust the stops as the pockets are moved along the endless path.

U.S. Pat. No. 6,390,469 discloses a sheet material conveying apparatus including a plurality of pockets, with each pocket having a setting device for adjusting a height of the pocket when the pocket is stationary, with the setting device including a setting rod, a ring gear and a lock ring. U.S. Pat. Nos. 5,251,888, 5,911,416 and 6,390,469 are incorporated by reference herein.

Flat rotating paddles are known for use on pockets to laterally register the printed products.

BRIEF SUMMARY OF THE INVENTION

The present invention provides a sheet material conveying apparatus comprising:

a plurality of pockets running along a track, each pocket having a first bottom and a second bottom movable between a first location where the second bottom is over the first bottom, and a second location where the second bottom is not located over the first bottom.

The pockets advantageously permit different formats to be received by the pockets, without the complexity associated with a slidable or actuatable single bottom.

The present invention also provides a pocket for printed material comprising a first bottom and a second bottom movable between a first location where the second bottom is over the first bottom, and a second location where the second bottom is not located over the first bottom.

The present invention also provides a method for permitting collection of two format sizes in movable pockets, comprising the steps of:

receiving first printed material of a first format size to contact a first bottom of a movable pocket;

moving a second bottom over the first bottom of the movable pocket; and receiving a second printed material of a second format size to contact the second bottom of the movable pocket.

The present invention also provides a sheet material conveying apparatus comprising:

a plurality of pockets running along a track; and a rotatable paddle having a convex outer surface for pushing a printed product in the pocket laterally.

The convex outer surface of the rotatable paddle is particularly advantageous when variable formats are used, as lifting of the printed product can be avoided.

BRIEF DESCRIPTION OF THE DRAWINGS

A preferred embodiment of the present invention is described below by reference to the following drawings, in which.

DETAILED DESCRIPTION OF A PREFERRED EMBODIMENT

Figure 1:
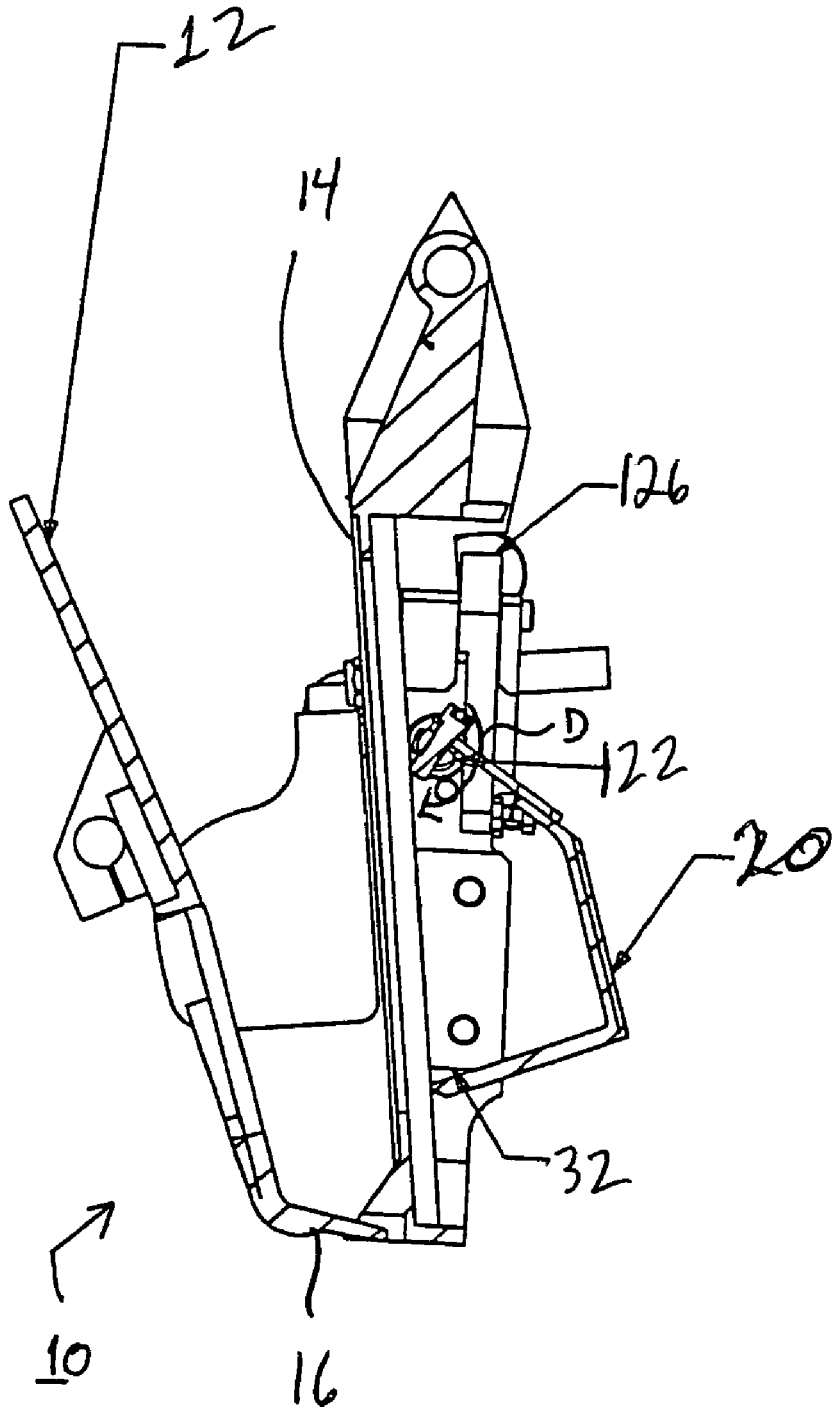
FIG. 1 shows a cross-section view of a pocket according to the present invention with the second bottom not located over the bottom.

FIG. 1 shows a side view of a pocket 10 according to the present invention with a first pocket wall 12 and second pocket wall 14 defining a receiving area for printed material therebetween. Pocket 10 has a first bottom 16, which may for example be an integral section of the one of the first and second walls 12, 14. Printed material having a certain format may be collected in the pockets, for example by a plurality of sheet feeding stations above the pockets, so that a collected printed product rests against the bottom 16. Collection may include collation or insertion of printed materials.

Bottom 16 may be movable, for example by rotation, to release the collected printed material through the bottom. Second pocket wall 14 may be fixed with respect to a shaft or device connecting the pocket 10 to a track.

Figure 2:
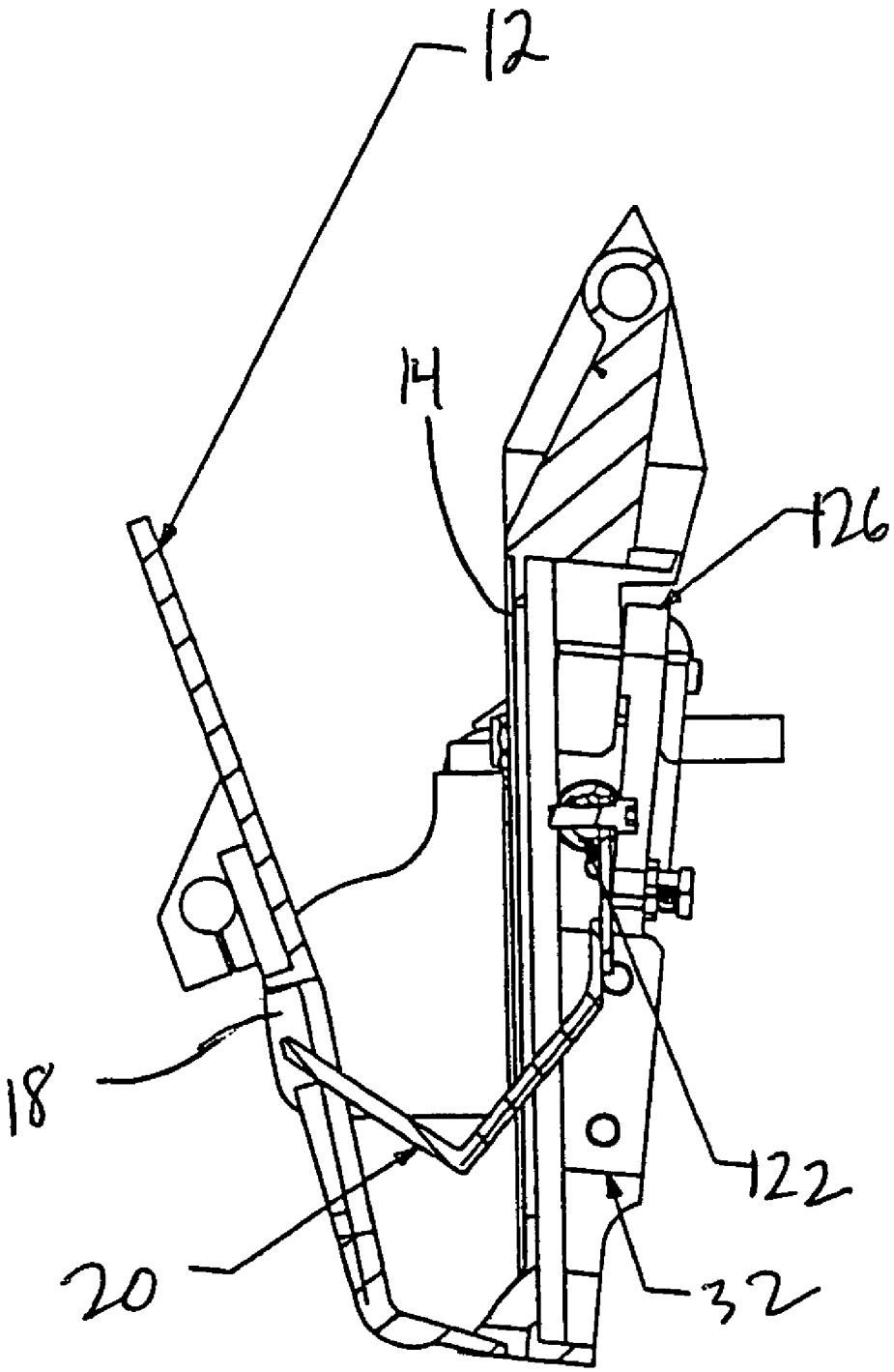
FIG. 2 shows a cross-section view of a pocket according to the present invention with the second bottom located over the bottom.
Figure 3:
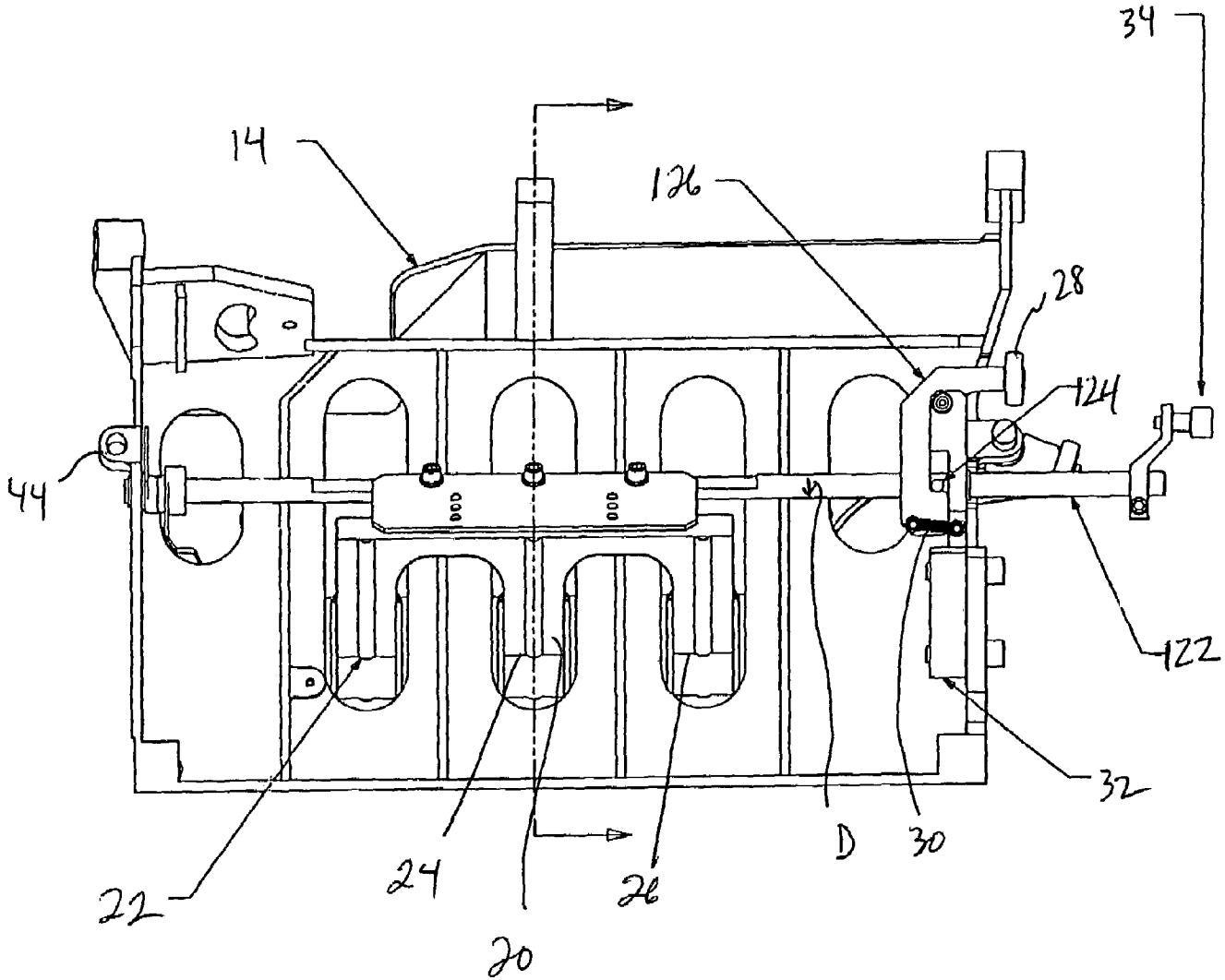
FIG. 3 shows a section view of the FIG. 1 view.

A second bottom 20 is moveable with respect to the first bottom 16, as shown in FIG. 2. Second bottom 20 may for example have a plurality of fingers 22, 24, 26 as shown in FIG. 3 which fit through openings in second pocket wall 14. First wall 12 may also have an opening or openings 18 for tips of finger or fingers 20.

Second bottom 20 thus advantageously can provide a second stop for printed material in the pocket, the printed material being for example a smaller format printed product. The higher bottom 20 may be necessary or advantageous for example to properly collect a succession of plurality of smaller format printed materials in the pocket 10.

FIG. 3 shows an end view of the FIG. 1 view and shows second bottom 20 fixedly attached to a shaft 122, which may be spring-loaded for example to rotate in direction D to pass through the openings in wall 14. A pin 124 fixed to shaft 122 may prevent the shaft from rotating in this direction by interacting with a latch 126 when the second bottom 20 is not over first bottom 16 as shown in FIGS. 1 and 3.

Pocket 10 passes a cam to move a cam follower 28 downwardly which rotates latch 126 with respect to a latch block 32 against the action of a spring 30 to release the latch. Shaft 122 and thus second bottom 20 rotate so that second bottom 20 passes through openings in wall 14 and assumes the position shown in FIGS. 2 and 4 where second bottom 20 is over first bottom 16. Cam follower 28 can be released so latch 126 rests against pin 124 and cannot close. The position of second bottom 20 is stable via the spring-loading on shaft 122.

Second bottom 20 then may return to the position in FIGS. 1 and 3 when a cam follower 34 is pushed downwardly via a cam to rotate shaft 122 opposite the direction of its spring-loading, i.e. so that pin 124 moves upwardly. Latch 126 then can close via the action of spring 30 so that second bottom 20 is not located over first bottom 16.

To release printed products from the bottom of the pockets 10 when the second bottom 20 is used to collect the printed material, the second bottom 20 may be moved away while first wall 12 and first bottom 16 are rotated out of the way. It may be preferable however to first move second bottom 20 after collection so that the printed products first drop onto first bottom 16, and then release the printed products by moving away the first bottom 16. This two-step procedure may reduce the forces due to gravity experienced by the printed products.

Figure 4:
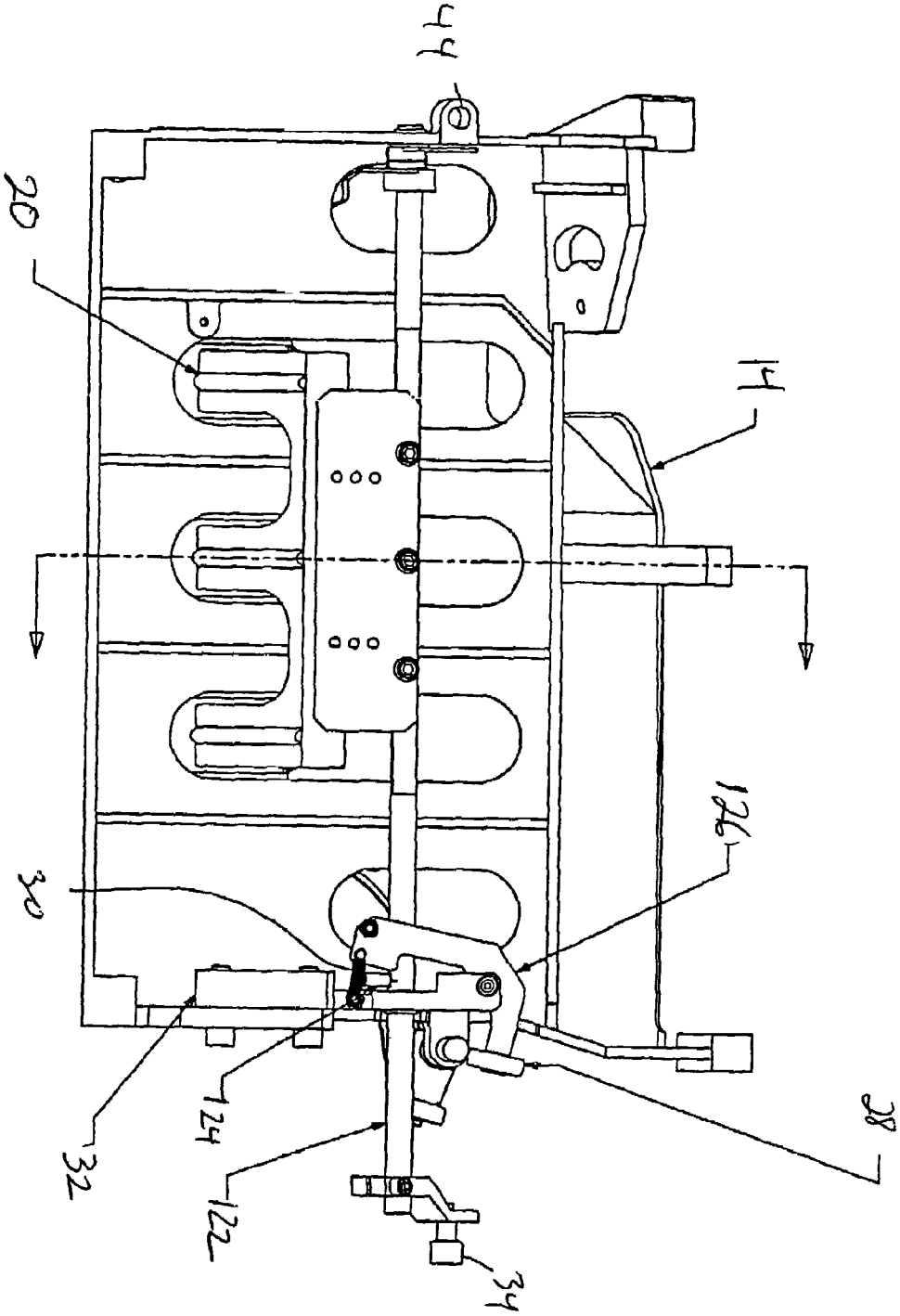
FIG. 4 shows a section view of the FIG. 2 view.
Figure 5:
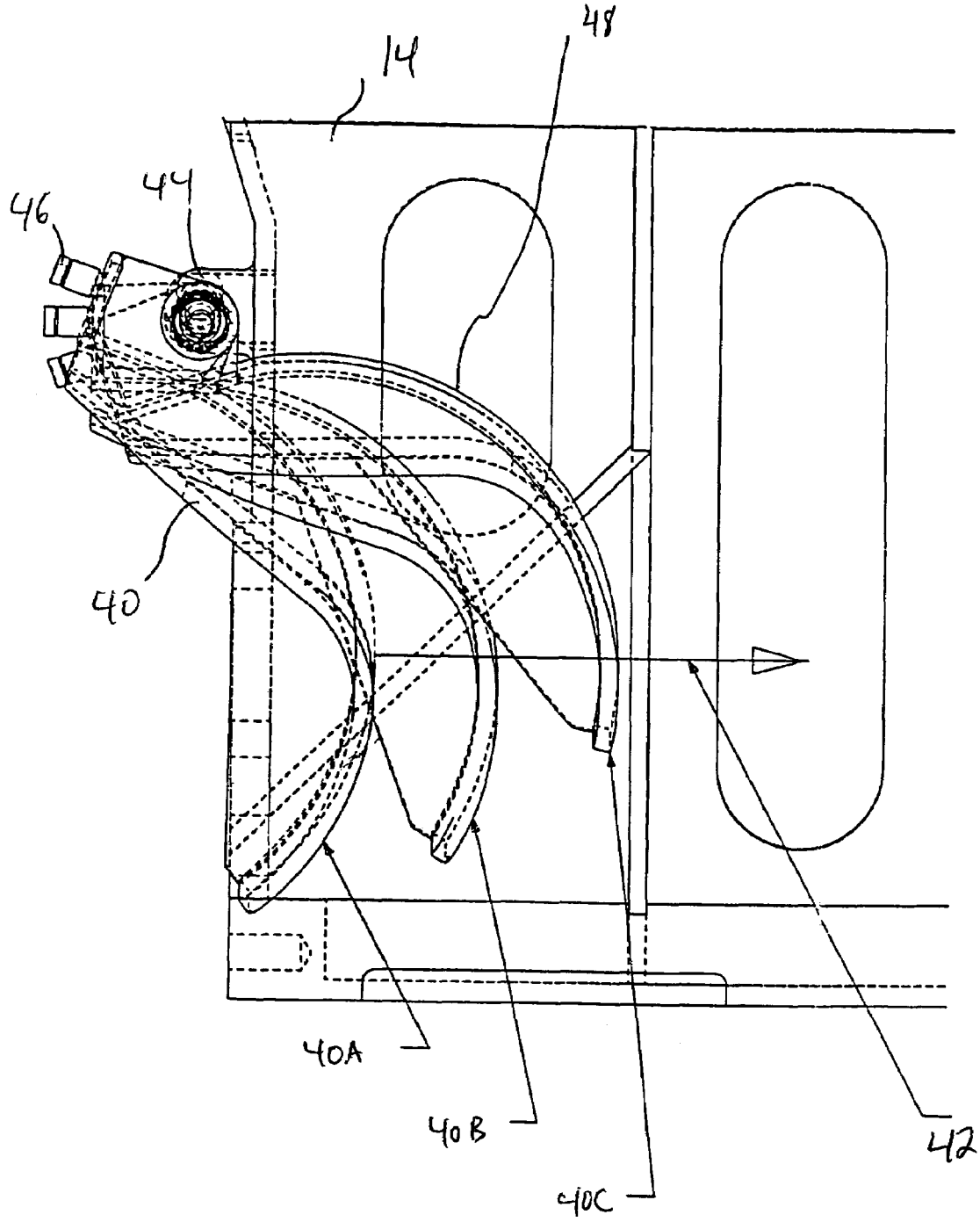
FIGS. 5 and 6 show views of the side paddle of the pocket in FIGS. 1 to 4.
Figure 6:
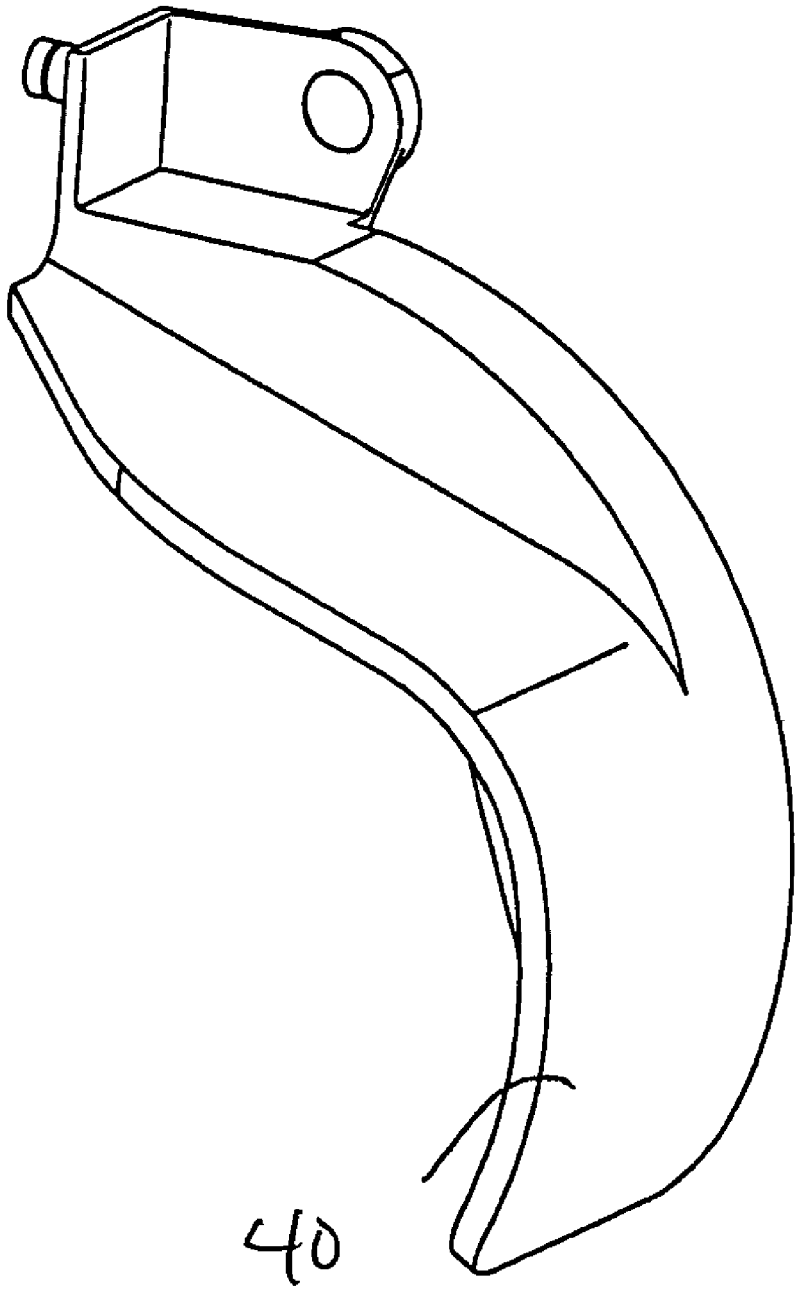

FIGS. 5 and 6 show views of the curved side paddle 40 of the pocket 10, which may be attached to wall 14 for example at an extension 44 as shown in FIGS. 3 and 4. A cam follower 46 may move the paddle 40 to rotate about extension 44, as shown by positions 40A, 40B, 40C. Paddle 40 has with a convex outer surface 48 with respect to printed products in the pocket 10 and can move the printed products laterally in direction 42 so that the printed products are positioned properly and laterally registered for delivery. The convex outer surface 48 is particularly advantageous for use with rotating paddles on variable format pockets, as the convex structure helps prevent smaller printed products from being lifted when contacted by the paddle as opposed to known flat paddles.

The present invention is not limited to solely dual format pockets, as it may be possible to add a third or more bottoms over the first and second bottoms for further formats.

A plurality of the pockets may be moved along a track, as described for example in incorporated by reference U.S. Pat. Nos. 5,251,888, 5,911,416 and 6,390,469, to define a conveying apparatus.

Existing pockets, for example from an NP632 inserter pocket available commercially from Goss International Corporation, may be retrofitted to have the second bottom.

What is claimed is:

1. A sheet material conveying apparatus comprising:

a plurality of pockets running along a track, each pocket having a first bottom and a second bottom movable between a first location where the second bottom is over the first bottom, and a second location where the second bottom is not located over the first bottom, the first bottom defining a first stop for collected sheet material of a first format, and the second bottom defining a second stop for collected sheet material of a second format.

2. The apparatus as recited in claim 1 wherein each pocket further includes a cam follower to the side of the pocket for moving the second bottom between the first and second locations.

3. The apparatus as recited in claim 1 wherein the first bottom is movable to release a collected printed product.

4. The apparatus as recited in claim 1 wherein each pocket includes a rotatable shaft, the second bottom being fixed to the shaft.

5. The apparatus as recited in claim 4 wherein the shaft includes a latch pin.

6. The apparatus as recited in claim 1 wherein the second bottom includes a plurality of fingers.

7. The apparatus as recited in claim 6 wherein each pocket includes a wall having openings, the fingers passing through the openings.

8. The apparatus as recited in claim 1 wherein each pocket includes a rotatable paddle with a convex outer surface.

9. The method as recited in claim 1 wherein each pocket has a movable first sidewall and a second sidewall.

10. A pocket for printed material comprising:

a first bottom; and a second bottom movable between a first location where the second bottom is over the bottom, and a second location where the second bottom is not located over the bottom, the first bottom defining a first stop for collected sheet material of a first format, and the second bottom defining a second stop for collected sheet material of a second format.

11. A method for permitting collection of two format sizes in movable pockets, comprising the steps of:

receiving first printed material of a first format size to contact a first bottom of a movable pocket, the first bottom defining a stop for collecting the first printed material;

moving a second bottom over the first bottom of the movable pocket; and receiving a second printed material of a second format size to contact the second bottom of the movable pocket.

12. The method as recited in claim 11 further comprising releasing the first printed material through the pocket by moving the first bottom.

13. The method as recited in claim 12 further comprising releasing the second printed material through the pocket by moving the first and second bottoms.

14. The method as recited in claim 13 wherein the second bottom is moved to release the second printed material before the first bottom is moved.

15. The method as recited in claim 11 wherein the second bottom is cam-actuated.

16. The method as recited in claim 11 wherein the second bottom rotates.

* * * * *